US011040542B2

(12) United States Patent
Tanabe et al.

(10) Patent No.: US 11,040,542 B2
(45) Date of Patent: Jun. 22, 2021

(54) INKJET PRINTER WITH DUAL CLEANING UNITS

(71) Applicant: SEIKO EPSON CORPORATION, Tokyo (JP)

(72) Inventors: Kentaro Tanabe, Azumino (JP); Sandro Robustelli, Villa Guardia (JP); Rodolfo Cazzaniga, Cassago Brianza (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/745,745

(22) Filed: Jan. 17, 2020

(65) Prior Publication Data

US 2020/0230962 A1 Jul. 23, 2020

(30) Foreign Application Priority Data

Jan. 21, 2019 (JP) ..... JP2019-007738

(51) Int. Cl.
*B41J 2/165* (2006.01)

(52) U.S. Cl.
CPC ..... *B41J 2/16552* (2013.01); *B41J 2/16538* (2013.01); *B41J 2002/16558* (2013.01)

(58) Field of Classification Search
CPC ..... B41J 2/16552; B41J 2/16538; B41J 2/16541; B41J 11/007; B41J 29/17
See application file for complete search history.

(56) References Cited

U.S. PATENT DOCUMENTS

2008/0218550 A1* 9/2008 Tsuji et al. ..... B41J 29/17
2014/0198161 A1 7/2014 Kanemoto
2016/0355037 A1* 12/2016 Yamaguchi ..... B41J 11/007
2017/0253061 A1* 9/2017 Kanemoto ..... B41J 11/007

FOREIGN PATENT DOCUMENTS

JP 2005280942 10/2005
JP 2006272834 10/2006
JP 2014136625 7/2014
JP 2006-272834 A * 10/2016

* cited by examiner

*Primary Examiner* — Sharon Polk
(74) *Attorney, Agent, or Firm* — Workman Nydegger

(57) ABSTRACT

An inkjet printer includes an endless transporting belt that transports a medium in a transport direction by supporting the medium and rotating, an ejecting unit that ejects ink onto the medium supported by the transporting belt, and a cleaning unit including a first brush for cleaning the transporting belt, a first cleaning liquid tank that stores cleaning liquid with which the first brush is impregnated, a second brush for cleaning the transporting belt, and a second cleaning liquid tank that stores the cleaning liquid with which the second brush is impregnated. The second cleaning liquid tank is disposed at a position lower than the first cleaning liquid tank in the vertical direction, and the cleaning unit is configured so that the cleaning liquid discharged from the first cleaning liquid tank is supplied to the second cleaning liquid tank.

5 Claims, 4 Drawing Sheets

INKJET PRINTER WITH DUAL CLEANING UNITS

The present application is based on, and claims priority from JP Application Serial No. 2019-007738, filed Jan. 21, 2019, the disclosure of which is hereby incorporated by reference herein in its entirety.

BACKGROUND

1. Technical Field

The present disclosure relates to an inkjet printer.

2. Related Art

In related art, various inkjet printers are used. Among those, there is an inkjet printer provided with a transporting belt that transports a medium, an ejecting unit that ejects ink onto the medium being transported, and a cleaning unit for cleaning the transporting belt. For example, JP-A-2006-272834 discloses an inkjet recording device that is provided with a transporting belt, a recording head that ejects ink onto a medium being transported, and two transporting belt cleaning devices provided at different positions in the vertical direction.

However, in a configuration in which a plurality of cleaning devices are provided at different positions in the vertical direction, as in the inkjet recording device disclosed in JP-A-2006-272834, when attempting to install a supply path for cleaning liquid in cleaning liquid tanks of the cleaning devices, there is a risk that a flow path configuration for the cleaning liquid may become complex. First, when the plurality of cleaning liquid tanks are provided at different positions in the vertical direction, a required height of the liquid surface of the cleaning liquid is different in each of the cleaning liquid tanks. Thus, each of the cleaning liquid tanks needs to be independent from each other. In addition, when the supply path for the cleaning liquid is individually provided from a supply source of the cleaning liquid, such as a tap, to each of the cleaning liquid tanks, it is necessary to branch the supply path extending from the supply source into a plurality of the supply paths that are allocated to each of the cleaning liquid tanks. Therefore, there is a risk that the flow path configuration for the cleaning liquid may become complex.

SUMMARY

An inkjet printer for solving the above-described problem includes an endless transporting belt configured to transport a medium in a transport direction by supporting the medium and rotating, an ejecting unit configured to eject ink onto the medium supported by the transporting belt, and a cleaning unit including a first brush for cleaning the transporting belt, a first cleaning liquid tank that stores cleaning liquid with which the first brush is impregnated, a second brush for cleaning the transporting belt, and a second cleaning liquid tank that stores the cleaning liquid with which the second brush is impregnated. The second cleaning liquid tank is disposed at a position lower than the second cleaning liquid tank in a vertical direction, and the cleaning unit is configured so that the cleaning liquid discharged from the first cleaning liquid tank is supplied to the second cleaning liquid tank.

DESCRIPTION OF EXEMPLARY EMBODIMENTS

Figure 1:
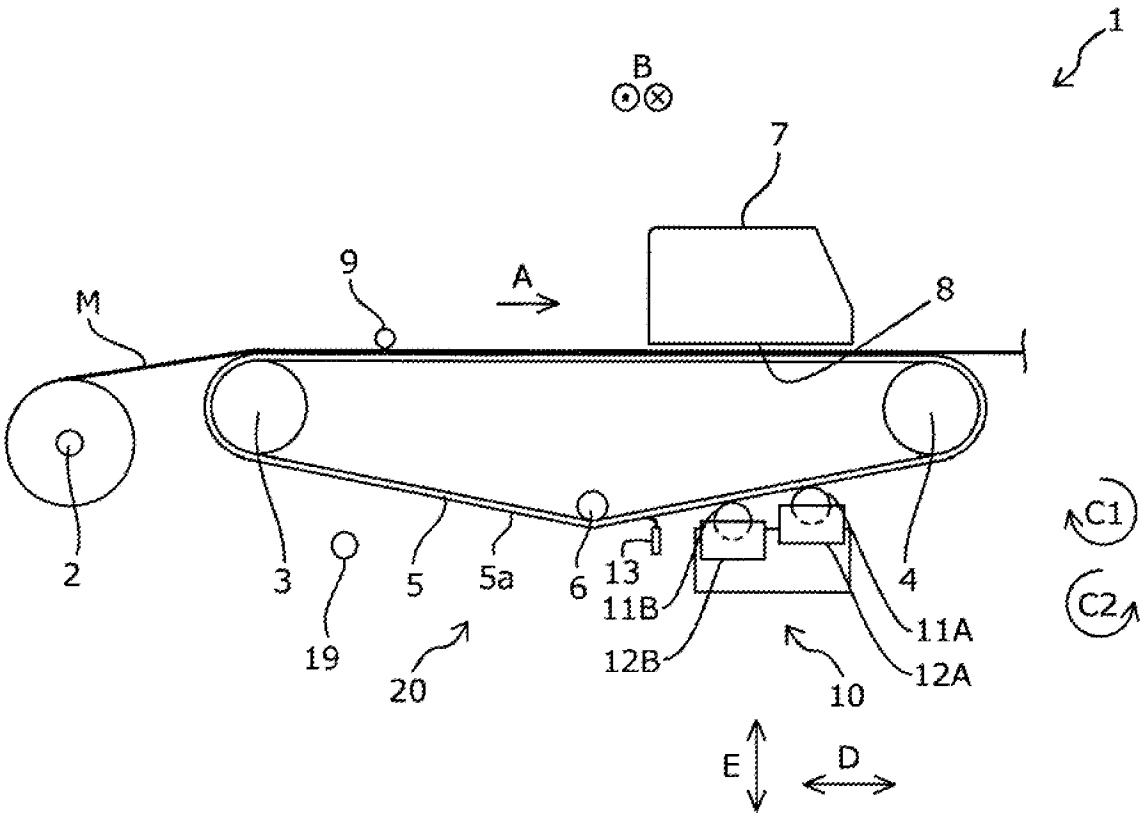
FIG. 1 is a schematic side view of an inkjet printer according to Example 1 of the present disclosure.

First, an outline description will be made of the present disclosure.

An inkjet printer of a first aspect for solving the above-described problem includes an endless transporting belt configured to transport a medium in a transport direction by supporting the medium and rotating, an ejecting unit configured to eject ink onto the medium supported by the transporting belt, and a cleaning unit including a first brush for cleaning the transporting belt, a first cleaning liquid tank that stores cleaning liquid with which the first brush is impregnated, a second brush for cleaning the transporting belt, and a second cleaning liquid tank that stores the cleaning liquid with which the second brush is impregnated. The second cleaning liquid tank is disposed at a position lower than the second cleaning liquid tank in a vertical direction, and the cleaning unit is configured so that the cleaning liquid discharged from the first cleaning liquid tank is supplied to the second cleaning liquid tank.

According to this aspect, the second cleaning liquid tank is disposed at a position lower than the first cleaning liquid tank in the vertical direction, and the cleaning unit is configured so that the cleaning liquid discharged from the first cleaning liquid tank is supplied to the second cleaning liquid tank. As a result, the cleaning liquid can be supplied from the first cleaning liquid tank to the second cleaning liquid tank using gravity. Thus, a configuration for a flow path of the cleaning liquid can be simplified compared to a case in which a supply path of the cleaning liquid is individually provided from a supply source of the cleaning liquid to each of the cleaning liquid tanks.

According to the inkjet printer of a second aspect of the present disclosure, in the first aspect, the first cleaning liquid tank and the second cleaning liquid tank are configured respectively by individual tanks separated from each other, and the cleaning unit includes a cleaning liquid flow path for supplying the cleaning liquid discharged from the first cleaning liquid tank to the second cleaning liquid tank.

According to this aspect, by configuring the first cleaning liquid tank and the second cleaning liquid tank by the individual tanks separated from each other, the position, size, and the like of each of the first cleaning liquid tank and the second cleaning liquid tank can be optimized.

According to the inkjet printer of a third aspect of the present disclosure, in the second aspect, the first cleaning liquid tank and the second cleaning liquid tank are configured to be movable independently of each other.

According to this aspect, since the first cleaning liquid tank and the second cleaning liquid tank are movable independently of each other, the position of each of the first cleaning liquid tank and the second cleaning liquid tank relative to the transporting belt can be easily optimized.

According to the inkjet printer of a fourth aspect of the present disclosure, in the first aspect, the first cleaning liquid tank and the second cleaning liquid tank are formed by partitioning a single tank into a plurality of compartments.

According to this aspect, it is possible to easily form the first cleaning liquid tank and the second cleaning liquid tank by partitioning the single tank.

According to the inkjet printer of a fifth aspect of the present disclosure, in any one of the first to fourth aspects, the first cleaning liquid tank and the second cleaning liquid tank are configured to be movable integrally.

According to this aspect, since the first cleaning liquid tank and the second cleaning liquid tank are movable integrally, the positions of the first cleaning liquid tank and the second cleaning liquid tank relative to the transporting belt can be adjusted integrally.

According to the inkjet printer of a sixth aspect of the present disclosure, in any one of the first to fifth aspects, the first cleaning liquid tank includes a first discharge path for discharging the cleaning liquid stored in the first cleaning liquid tank to the second cleaning liquid tank and a first opening/closing portion that opens and closes the first discharge path, and the second cleaning liquid tank includes a second discharge path for discharging the cleaning liquid stored in the second cleaning liquid tank and a second opening/closing portion that opens and closes the second discharge path.

According to this aspect, by opening and closing the first discharge path and the second discharge path using the first opening/closing portion and the second opening/closing portion, the cleaning liquid can be easily stored in the first cleaning liquid tank and the second cleaning liquid tank when the inkjet printer is used, and the cleaning liquid can be easily discharged from the first cleaning liquid tank and the second cleaning liquid tank when the inkjet printer is not used.

Embodiments of the present disclosure will be described below with reference to the accompanying drawings.

Figure 2:
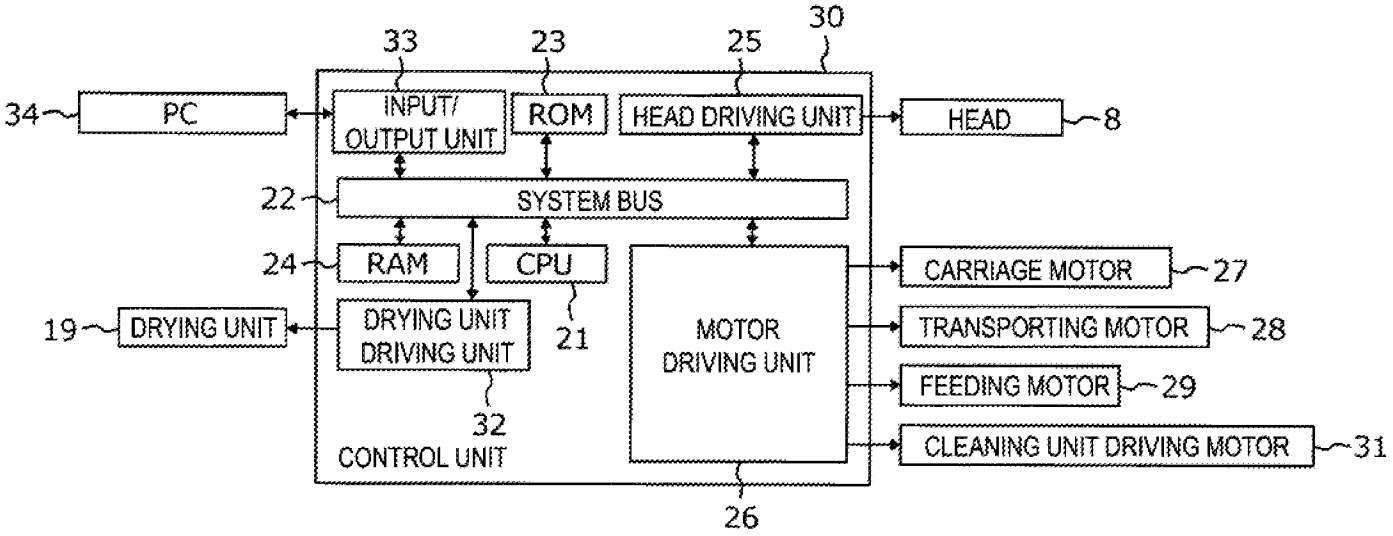
FIG. 2 is a block diagram illustrating an electrical configuration of the inkjet printer according to Example 1 of the present disclosure.
Figure 3:
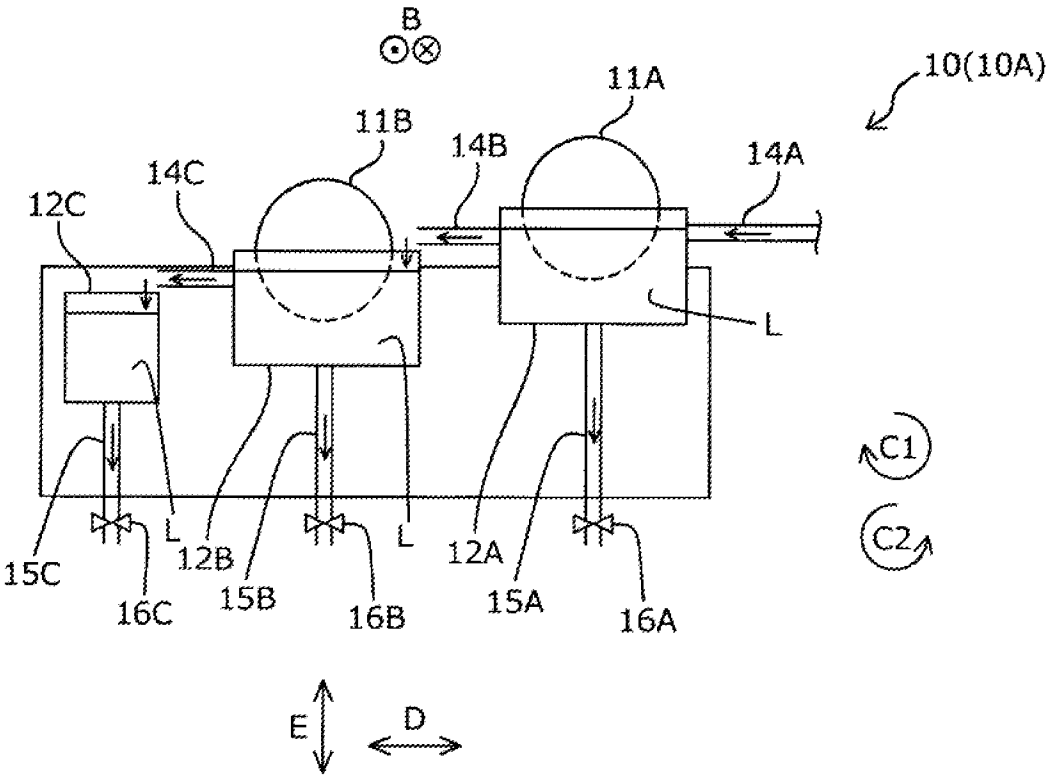
FIG. 3 is a schematic side view of a cleaning unit of the inkjet printer according to Example 1 of the present disclosure.

Example 1 FIG. 1 to FIG. 3

First, an outline of an inkjet printer 1 according to Example 1 of the present disclosure will be described with reference to FIG. 1.

As illustrated in FIG. 1, the inkjet printer 1 of this example is provided with a setting unit 2 on which a roll-type medium M is set. In addition, the inkjet printer 1 is provided with a transport device 20 capable of transporting the medium M, which is fed from the setting unit 2, in a transport direction A. The transport device 20 is provided with a driven roller 3 located upstream in the transport direction A, a driving roller 4 located downstream in the transport direction A, a transporting belt 5 that is an endless belt stretched across the driven roller 3 and the driving roller 4, and an adjustment roller 6 that adjusts various parameters of the transporting belt 5. The parameters that can be adjusted by the adjustment roller 6 are specifically the circumferential length of the transporting belt 5 and the tension of the transporting belt 5. In addition, the inkjet printer 1 is provided with a cleaning unit 10 for cleaning the transporting belt 5, and a drying unit 19 that is a heater for drying the transporting belt 5. Note that the cleaning unit 10, which is a main component of the inkjet printer 1 of this example, will be described below in detail.

Here, the transporting belt 5 is an adhesive belt coated with an adhesive on a support surface 5*a*, which is a surface on the outer side of the transporting belt 5. As illustrated in FIG. 1, the medium M is supported and transported by the transporting belt 5 in a state in which the medium M is adhered to the support surface 5*a* coated with the adhesive. In other words, the transporting belt 5 is a support portion for the medium M. A support region over which the transporting belt 5 supports the medium M is an upper-side region of the transporting belt 5 stretched across the driven roller 3 and the driving roller 4. Further, the driving roller 4 is a roller that rotates as a result of a driving force of a motor (not illustrated), and the driven roller 3 is a roller that rotates as a result of being driven by the rotation of the transporting belt 5 in accordance with the driving roller 4 being rotated.

Note that, similarly to the driven roller 3, the adjustment roller 6 is also a roller that rotates as a result of being driven by the rotation of the transporting belt 5 in accordance with the driving roller 4 being rotated. The adjustment roller 6 is configured so that an end portion on a first side and an end portion on a second side in a width direction B are each independently movable in a vertical direction E. As a result, the circumferential length on the first side in the width direction B of the transporting belt 5 and the circumferential length on the second side in the width direction B of the transporting belt 5 can be individually changed. When the circumferential length of the transporting belt 5 differs between the first side and the second side in the width direction B, there is a risk that the medium M may meander when the medium M is transported. Therefore, it is preferable that the difference in the circumferential lengths between the first side and the second side in the width direction B be as small as possible. For example, if the circumferential length of the first side in the width direction B of the transporting belt 5 is longer than the circumferential length on the second side in the width direction B of the transporting belt 5, by moving the end portion on the first side in the width direction B of the adjustment roller 6 upward in the vertical direction E, the circumferential length of the transporting belt 5 on the first side in the width direction B is shortened, and the difference in the circumferential lengths between the first side and the second side in the width direction B of the transporting belt 5 can thus be reduced. Alternatively, in a similar situation, by moving the end portion on the second side in the width direction B of the adjustment roller 6 downward in the vertical direction E, the circumferential length of the transporting belt 5 on the second side in the width direction B is increased, and the difference in the circumferential lengths between the first side and the second side in the width direction B of the transporting belt 5 can thus be reduced. Note that although the difference in the circumferential lengths is ideally zero, there may be some difference in the circumferential lengths as long as it is to an extent at which the medium M does not meander.

Further, the adjustment roller 6 can also be used to adjust the tension of the transporting belt 5. For example, by moving the end portion on the first side and the end portion on the second side in the width direction B of the adjustment roller 6 in the vertical direction E by equal movement amounts, the tension of the transporting belt 5 can be adjusted without changing the difference in the circumferential lengths between the first side and the second side in the width direction B of the transporting belt 5. Specifically, by moving the end portion on the first side and the end portion on the second side in the width direction B of the adjustment roller 6 upward in the vertical direction E, the tension of the transporting belt 5 is weakened. In addition, by moving the end portion on the first side and the end portion on the second side in the width direction B of the adjustment roller 6 downward in the vertical direction E, the tension of the transporting belt 5 is increased.

Note that, as a result of the adjustment roller 6 being provided, in the transport device 20 of this example, the support surface 5*a* of the transporting belt 5 at a position facing the cleaning unit 10 is an inclined surface. Here, the "inclined surface" refers to a surface having a predetermined angle with respect to both the vertical direction E and a horizontal direction D, in a side view. In this example, for convenience, the predetermined angle of the inclined surface with respect to the horizontal direction D is defined as an inclination angle of the inclined surface.

Further, the inkjet printer 1 is provided with a carriage 7 capable of reciprocating in the width direction B intersecting the transport direction A, and a head 8 attached to the carriage 7. The head 8 functions as an ejecting unit capable of ejecting ink onto, and forming an image on, the medium M transported in the transport direction A. The head 8 is provided in a position facing the support region of the medium M on the transporting belt 5, and is capable of ejecting ink. At this time, the support region of the medium M on the transporting belt 5 can be said to be an opposing region facing the head 8. The inkjet printer 1 of this example is capable of printing the image by ejecting ink from the head 8 onto the transported medium M, while causing the carriage 7 to reciprocate in the width direction B intersecting the transport direction A. As a result of being provided with the carriage 7 configured in this manner, the inkjet printer 1 of this example can form a desired image on the medium M by repeating the transport of the medium M in the transport direction A by a predetermined transport amount, and the ejection of the ink while moving the carriage 7 in the width direction B in a state in which the medium M is stopped.

Note that the inkjet printer 1 according to this example is a so-called serial printer that performs the printing by alternately repeating the transport of the medium M by the predetermined transport amount and the reciprocating movement of the carriage 7. However, the inkjet printer 1 may be a so-called line printer, which uses a line head in which nozzles are formed in a line shape along the width direction B of the medium M, and which continuously performs printing while continuously transporting the medium M.

In addition, a medium affixing portion 9 is formed at a position facing the transporting belt 5, further upstream in the transport direction A than the carriage 7. The medium affixing portion 9 affixes the medium M to the transporting belt 5 in a state in which the generation of wrinkles and the like is suppressed, by pressing the medium M against the transporting belt 5 across the width direction B.

After being discharged from the inkjet printer 1 of this example, the medium M on which the image has been formed is fed to a drying device that volatilizes components of the ink ejected onto the medium M, a winding device that takes up the medium M on which the image has been formed, and the like, which are provided at subsequent stages following the inkjet printer 1 of this example.

Here, a material for textile printing can be preferably used as the medium M. The term "material for textile printing" refers to a fabric, a garment, other clothing products and the like that are subject to textile printing. Fabrics include woven cloths, knit fabrics, non-woven cloths, and the like made of natural fibers such as cotton, silk, wool, and the like, chemical fibers such as nylon and the like, or composite fibers of natural fibers and chemical fibers. Further, the garments and other clothing products include sewn products, such as T-shirts, handkerchiefs, scarfs, towels, handbags, and fabric bags, furniture-related products such as curtains, sheets, and bed covers, as well as fabrics and the like before and after cutting that serve as pieces of cloth before sewing.

Further, in addition to the material for textile printing described above, dedicated inkjet printing paper, such as plain paper, high quality paper, glossy paper, and the like, can be used as the medium M. Further, for example, a plastic film whose surface has not been treated for inkjet printing, that is, on which an inkjet absorption layer is not formed, as well as a material in which plastic is coated on a substrate of paper or the like, and a material to which a plastic film has been adhered can also be used as the medium M. Such plastic materials include, but are not limited to, for example, polyvinyl chloride, polyethylene terephthalate, polycarbonate, polystyrene, polyurethane, polyethylene, and polypropylene.

When the material for textile printing is used as the medium M, the material for textile printing is susceptible to strike-through of the ink, in which the ink ejected onto the medium M seeps through to a surface on the reverse side of the medium M, and there are cases in which the transport belt 5 is stained by the ink. Here, the inkjet printer 1 of this example is provided with the cleaning unit 10 for cleaning up the ink that has adhered to the transporting belt 5 as a result of the strike-through. Although a detailed configuration will be described below, the cleaning unit 10 of this example is provided with a first cleaning liquid tank 12A that stores a cleaning liquid L (refer to FIG. 3), a first brush 11A that is impregnated with the cleaning liquid L of the first cleaning liquid tank 12A and comes into contact with the transporting belt 5, a second cleaning liquid tank 12B that stores the cleaning liquid L, and a second brush 11B that is impregnated with the cleaning liquid L of the second cleaning liquid tank 12B and comes into contact with the transporting belt 5. In this example, water is used as the cleaning liquid L. However, other types of liquid may be used as the cleaning liquid L. For example, liquid containing a predetermined cleaning component may be used as the cleaning liquid L.

Here, a movement mechanism of the cleaning unit 10 will be described. The cleaning unit 10 is configured so that a set of the first brush 11A and the first cleaning liquid tank 12A and a set of the second brush 11B and the second cleaning liquid tank 12B are each individually movable in the horizontal direction D and the vertical direction E. Thus, the first brush 11A and the second brush 11B are configured to be able to suitably come into contact with the inclined support surface 5*a* of the transporting belt 5.

For example, when the adjustment roller 6 is moved in the vertical direction E, the inclination angle of the inclined support surface 5*a* changes. When the adjustment roller 6 is moved upward in the vertical direction E, the inclination angle decreases. At this time, since the transporting belt 5 is caused to move inward, the inclined support surface 5*a* may become separated from the first brush 11A and the second brush 11B. In such a case, the set of the first brush 11A and the first cleaning liquid tank 12A and the set of the second brush 11B and the second cleaning liquid tank 12B are moved so as to be individually closer to the inclined support surface 5*a*. In addition, when the adjustment roller 6 is moved downward in the vertical direction E, the inclination angle increases. At this time, since the transporting belt 5 is caused to protrude outward, the inclined support surface 5*a* may intrude excessively with respect to the first brush 11A and the second brush 11B. In such a case, the set of the first brush 11A and the first cleaning liquid tank 12A and the set of the second brush 11B and the second cleaning liquid tank 12B are moved so as to be individually separated from the inclined support surface 5*a*.

By individually moving the first brush 11A and the second brush 11B as described above, positions of the first brush 11A and the second brush 11B relative to the transporting belt 5 can be adjusted in a detailed manner. However, the first brush 11A and the second brush 11B may be configured to integrally move in the horizontal direction D and the vertical direction E. In other words, the cleaning unit 10 may be configured to move integrally. With such a configuration, the positions of the first brush 11A and the second brush 11B relative to the transporting belt 5 can be adjusted integrally.

Further, the first brush 11A and the second brush 11B may have a configuration in which the first brush 11A and the second brush 11B can move both individually and integrally. For example, such a configuration can be achieved by providing both a movement mechanism that moves the cleaning unit 10 integrally and a movement mechanism that moves the first brush 11A and the second brush 11B individually. At this time, a rough positional adjustment may be performed by moving the entire cleaning unit 10, and a fine positional adjustment may be performed by moving the first brush 11A and the second brush 11B individually. By doing this, the positions of the first brush 11A and the second brush 11B can be adjusted efficiently and accurately.

Note that a direction in which the cleaning unit 10 is moved integrally and a direction in which the first brush 11A and the second brush 11B are moved individually may be one of the horizontal direction D and the vertical direction E, or may be another direction. Further, in any of the above configurations, the first cleaning liquid tank 12A is configured to move as a set with the first brush 11A, and the second cleaning liquid tank 12B is configured to move as a set with the second brush 11B.

In addition, the inkjet printer 1 of this example is provided with a blade portion 13 that wipes off the cleaning liquid L that has adhered to the transporting belt 5 as a result of bringing the first brush 11A and the second brush 11B into contact with the transporting belt 5. The blade portion 13 is also configured to be movable in the horizontal direction D and the vertical direction E, in the same manner as the first brush 11A and the second brush 11B. Thus, a position of the blade portion 13 can be adjusted in accordance with the change in the inclination angle of the inclined support surface 5*a*. Note that a direction in which the blade portion 13 is moved may be one of the horizontal direction D and the vertical direction E, or may be another direction. Alternatively, the blade portion 13 may be configured to move as a set with the cleaning unit 10.

In addition, the inkjet printer 1 of this example is provided with a drying unit 19 capable of drying the cleaning liquid L that has not been completely wiped off by the blade portion 13.

The inkjet printer 1 of this example is capable of transporting the medium M in the transport direction A by rotating the driving roller 4 in a rotation direction C1. Further, the inkjet printer 1 is also capable of transporting the medium M in the direction opposite from the transport direction A, by rotating the driving roller 4 in a rotation direction C2, which is the opposite direction from the rotation direction C1. Note that when the driving roller 4 is rotated in the rotation direction C1, the transporting belt 5 also rotates in the rotation direction C1, but at this time, the first brush 11A and the second brush 11B can be rotated in the rotation direction C2.

Next, the electrical configuration of the inkjet printer 1 of this example will be described with reference to FIG. 2.

As illustrated in FIG. 2, the inkjet printer 1 of this example is provided with a control unit 30. The control unit 30 is provided with a CPU 21 that controls the entire inkjet printer 1. The CPU 21 is connected, via a system bus 22, to a ROM 23 that stores various types of control programs to be executed by the CPU 21, and the like, and a RAM 24 that can temporarily store data.

Further, the CPU 21 is connected, via the system bus 22, to a head driving unit 25 for driving the head 8, that is, for ejecting ink.

Further, the CPU 21 is connected, via the system bus 22, to a motor driving unit 26 that is connected to a carriage motor 27, a transporting motor 28, a feeding motor 29, and a cleaning unit driving motor 31.

Here, the carriage motor 27 is a motor for causing the carriage 7, on which the head 8 is mounted, to reciprocate in the width direction B. Further, the transporting motor 28 is a motor for driving the driving roller 4. Furthermore, the feeding motor 29 is a rotary mechanism for the setting unit 2, and is a motor for driving the setting unit 2 in order to feed the medium M onto the transporting belt 5. Then, the cleaning unit driving motor 31 is a motor for driving the first brush 11A and the second brush 11B.

In addition, the CPU 21 is connected, via the system bus 22, to a drying unit driving unit 32 that drives the drying unit 19.

Further, the CPU 21 is connected, via the system bus 22, to an input/output unit 33 connected to a PC 34 for receiving and transmitting data, such as image data and signals.

Next, a detailed configuration of the cleaning unit 10, which is a main component of the inkjet printer 1 of this example, will be described in detail with reference to FIG. 3. Note that arrows in FIG. 3 indicate directions in which the cleaning liquid L flows.

As illustrated in FIG. 3, a cleaning unit 10A of this example is provided with the first brush 11A for cleaning the transporting belt 5 and the first cleaning liquid tank 12A that stores the cleaning liquid L with which the first brush 11A is impregnated. In addition, the cleaning unit 10A is provided with the second brush 11B for cleaning the transporting belt 5 and the second cleaning liquid tank 12B that stores the cleaning liquid L with which the second brush 11B is impregnated.

A cleaning liquid flow path 14A is connected to a supply source of the cleaning liquid L, such as a tap, and is a supply path for supplying the cleaning liquid L from the supply source to the cleaning unit 10A. Then, the first cleaning liquid tank 12A is configured to be able to receive the supply of the cleaning liquid L from the cleaning liquid flow path 14A. Further, the first cleaning liquid tank 12A is configured to be able to discharge the cleaning liquid L from a cleaning liquid flow path 14B and from a discharge path 15A provided with an opening/closing portion 16A.

The second cleaning liquid tank 12B is provided at a position that is displaced from the first cleaning liquid tank 12A in the horizontal direction D and that is lower than the first cleaning liquid tank 12A in the vertical direction E. Then, the second cleaning liquid tank 12B is configured to be able to receive the supply of the cleaning liquid L from the cleaning liquid flow path 14B. Further, the second cleaning liquid tank 12B is configured to be able to discharge the cleaning liquid L from a cleaning liquid flow path 14C and from a discharge path 15B provided with an opening/closing portion 16B.

Note that a third cleaning liquid tank 12C is provided at a position that is displaced from the second cleaning liquid tank 12B in the horizontal direction D and that is lower than the second cleaning liquid tank 1 B in the vertical direction E. Then, the third cleaning liquid tank 12C is configured to be able to receive the supply of the cleaning liquid L from the cleaning liquid flow path 14C. Further, the third cleaning liquid tank 12C is configured to be able to discharge the cleaning liquid L from a discharge path 15C provided with an opening/closing portion 16C. The opening/closing portion 16C is specifically a valve. Here, the third cleaning liquid tank 12C serves as a buffer region that prevents the cleaning liquid L from overflowing from the cleaning unit 10. The supply source of the cleaning liquid L, such as the tap, basically stops supplying the cleaning liquid L once a sufficient amount of the cleaning liquid L has been stored in the first cleaning liquid tank 12A and the second cleaning liquid tank 12B. However, if the cleaning liquid L overflows from the second cleaning liquid tank 12B for whatever reason, the cleaning liquid L is stored in the third cleaning liquid tank 12C that serves as the buffer region. In the inkjet printer 1, normally, the opening/closing portion 16C is closed, and the discharge path 15C is in a closed state. In this way, the cleaning liquid L overflowing from the second cleaning liquid tank 12B is stored in the third cleaning liquid tank 12C. Then, by opening the opening/closing portion 16C at any given timing, the discharge path 15C is caused to be in an open state, and the cleaning liquid L stored in the third cleaning liquid tank 12C is discharged from the discharge path 15C. For example, by providing a liquid level sensor or the like in the third cleaning liquid tank 12C, a user may be notified when the cleaning liquid L stored in the third cleaning liquid tank 12C exceeds a predetermined amount, and may be prompted to discharge the cleaning liquid L stored in the third cleaning liquid tank 12C. Note that a configuration may be adopted in which the third cleaning liquid tank 12C serving as the buffer region is not provided.

To summarize here, the inkjet printer 1 of this example is provided with the endless transporting belt 5 that transports the medium M in the transport direction A by supporting the medium M and rotating, the head 8 that ejects ink onto the medium M supported by the transporting belt 5, and the cleaning unit 10. The cleaning unit 10 includes the first brush 11A for cleaning the transporting belt 5, the first cleaning liquid tank 12A that stores the cleaning liquid L with which the first brush 11A is impregnated, the second brush 11B for cleaning the transporting belt 5, and the second cleaning liquid tank 12B that stores the cleaning liquid L with which the second brush 11B is impregnated. Here, the second cleaning liquid tank 12B is disposed at a position that is lower than the first cleaning liquid tank 12A in the vertical direction E. Further, the cleaning unit 10 has a configuration in which the cleaning liquid L discharged from the first cleaning liquid tank 12A is supplied to the second cleaning liquid tank 12B. Since the inkjet printer 1 of this example has such a configuration, the inkjet printer 1 is configured to be able to supply the cleaning liquid L from the first cleaning liquid tank 12A to the second cleaning liquid tank 12B using gravity. In other words, it is not necessary to extend the supply path from the supply source of the cleaning liquid L to the second cleaning liquid tank 12B. Thus, the configuration of the flow path of the cleaning liquid L is simplified compared to a case in which supply paths for the cleaning liquid are individually provided from the supply source of the cleaning liquid L to each of the cleaning liquid tanks.

Further, as illustrated in FIG. 3, in the inkjet printer 1 of this example, the first cleaning liquid tank 12A and the second cleaning liquid tank 12B are configured respectively by individual tanks separated from each other. Then, the cleaning unit 10A of this example has the cleaning liquid flow path 14B that supplies the cleaning liquid L discharged from the first cleaning liquid tank 12A to the second cleaning liquid tank 12B. In this way, by configuring the first cleaning liquid tank 12A and the second cleaning liquid tank 12B by the individual tanks separated from each other, the position, size, and the like of each of the first cleaning liquid tank 12A and the second cleaning liquid tank 12B can be optimized. Further, by including the cleaning liquid flow path 14B, the cleaning liquid L can be supplied from the first cleaning liquid tank 12A to the second cleaning liquid tank 12B without spillage of the cleaning liquid L. However, the configuration is not limited to such a configuration, and may be a configuration in which the cleaning liquid flow path 14B is not provided, and the cleaning liquid L flows directly from the first cleaning liquid tank 12A down to the second cleaning liquid tank 12B.

Further, as described above, in the cleaning unit 10A of this example, the cleaning unit 10 is configured so that the set of the first brush 11A and the first cleaning liquid tank 12A and the set of the second brush 11B and the second cleaning liquid tank 12B are each configured to be individually movable in the horizontal direction D and the vertical direction E. In other words, in the inkjet printer 1 of this example, the first cleaning liquid tank 12A and the second cleaning liquid tank 12B are configured to be movable independently of each other. Thus, the inkjet printer 1 of this example is configured to be able to easily optimize the position of each of the first cleaning liquid tank 12A and the second cleaning liquid tank 12B relative to the transporting belt 5, for example, even when the inclination angle of the support surface 5*a* of the inclined transporting belt 5 changes as a result of changing the position of the adjustment roller 6.

Further, as illustrated in FIG. 3, in the ink jet printer 1 of this example, the first cleaning liquid tank 12A includes the discharge path 15A that serves as a first discharge path for discharging the cleaning liquid L stored in the first cleaning liquid tank 12A without supplying the cleaning liquid L to the second cleaning liquid tank 12B, and the opening/closing portion 16A that serves as a first opening/closing portion for opening and closing the discharge path 15A. Then, the second cleaning liquid tank 12B includes the discharge path 15B as a second discharge path for discharging the cleaning liquid L stored in the second cleaning liquid tank 12B, and the opening/closing portion 16B that serves as a second opening/closing portion for opening and closing the discharge path 15B.

The opening/closing portion 16A and the opening/closing portion 16B are specifically valves. When the inkjet printer 1 is used, the opening/closing portion 16A is closed to cause the discharge path 15A to be in a closed state, and the opening/closing portion 16B is closed to cause the discharge path 15B to be in a closed state. In this way, the cleaning liquid L can be suitably stored in the first cleaning liquid tank 12A and the second cleaning liquid tank 12B. Further, when the ink jet printer 1 is not used, the opening/closing portion 16A is opened to cause the discharge path 15A to be in an open state, and the opening/closing portion 16B is opened to cause the discharge path 15B to be in an open state. In this way, the cleaning liquid L can be suitably discharged from the first cleaning liquid tank 12A and the second cleaning liquid tank 12B.

Thus, by opening and closing the discharge path 15A and the discharge path 15B using the opening/closing portion 16A and the opening/closing portion 16B, the inkjet printer 1 of this example can easily store the cleaning liquid L in the first cleaning liquid tank 12A and the second cleaning liquid tank 12B when the inkjet printer 1 is used, and can easily discharge the cleaning liquid L from the first cleaning liquid tank 12A and the second cleaning liquid tank 12B when the inkjet printer 1 is not used.

Figure 4:
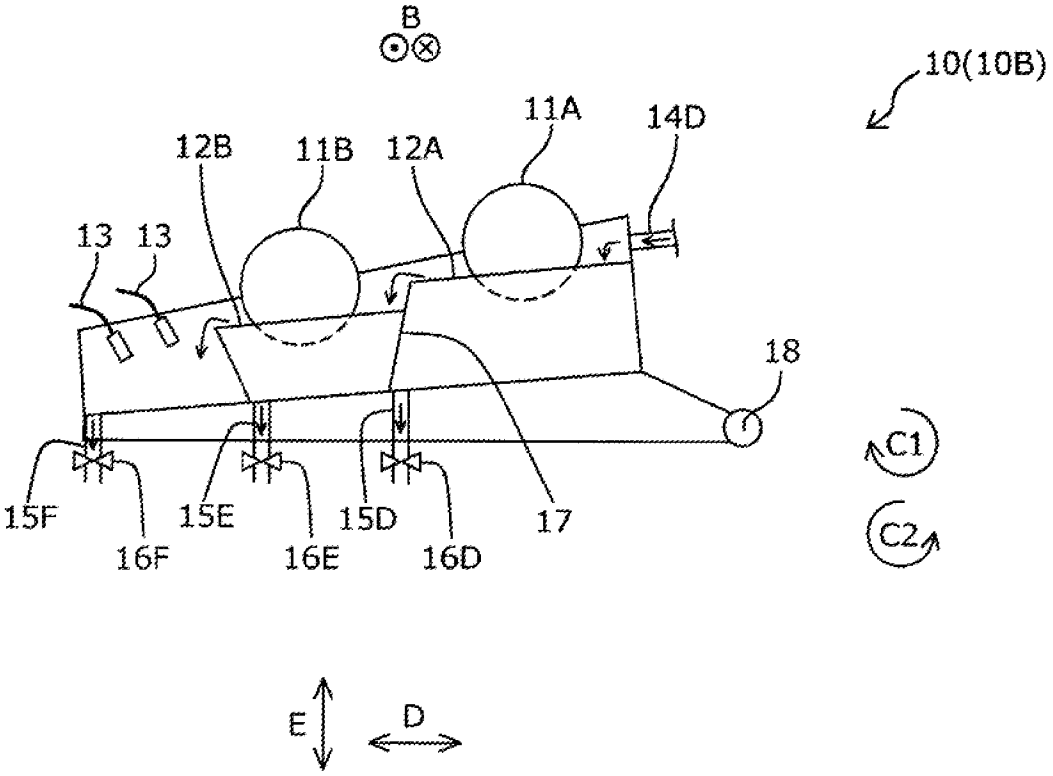
FIG. 4 is a schematic side view of a cleaning unit of the inkjet printer according to Example 2 of the present disclosure.

Example 2 FIG. 4

Next, the inkjet printer 1 of Example 2 will be described.

FIG. 4 is a schematic side view illustrating the cleaning unit 10 in the inkjet printer 1 of this example, and is a diagram corresponding to FIG. 3 illustrating the inkjet printer 1 according to Example 1. Here, the inkjet printer 1 of this example has the same configuration as that of the inkjet printer 1 of Example 1 apart from the cleaning unit 10, and a description of common portions of the configuration, such as portions other than the cleaning unit 10, is therefore omitted here. Note that the structural members common to those in Example 1 described above are denoted by the same reference numerals, and a detailed description thereof is omitted.

As illustrated in FIG. 4, a cleaning unit 10B of this example is provided with the first brush 11A for cleaning the transporting belt 5, and the first cleaning liquid tank 12A that stores the cleaning liquid L with which the first brush 11A is impregnated. In addition, the cleaning unit 10A is provided with the second brush 11B for cleaning the transporting belt 5 and the second cleaning liquid tank 12B that stores the cleaning liquid L with which the second brush 11B is impregnated. However, in the cleaning unit 10B of this example, the first cleaning liquid tank 12A and the second cleaning liquid tank 12B are simply separated by a partition 17 and are integrally formed. In other words, the first cleaning liquid tank 12A and the second cleaning liquid tank 12B are formed so as to be adjacent to each other while sharing the partition 17.

The first cleaning liquid tank 12A is configured to be able to receive the supply of the cleaning liquid L from a cleaning liquid flow path 14D. Further, the first cleaning liquid tank 12A is configured so as to be able to discharge the cleaning liquid L from an edge thereof closer to the partition 17, that is, from the edge thereof located downstream in the direction in which the cleaning liquid L flows. Furthermore, the first cleaning liquid tank 12A is configured to be able to discharge the cleaning liquid L from a discharge path 15D that serves as the first discharge path and that is provided with an opening/closing portion 16D that serves as the first opening/closing portion.

The second cleaning liquid tank 12B is provided at a position that is adjacent to the first cleaning liquid tank 12A in the horizontal direction D and that is lower than the first cleaning liquid tank 12A in the vertical direction E. Then, the second cleaning liquid tank 12B is configured to be able to receive the supply of the cleaning liquid L from the edge of the first cleaning liquid tank 12A closer to the partition 17. Further, the second cleaning liquid tank 12B is configured to be able to discharge the cleaning liquid L from an edge thereof located opposite to the partition part 17, that is, from the edge thereof located downstream in the direction in which the cleaning liquid L flows. Furthermore, the second cleaning liquid tank 12B is configured to be able to discharge the cleaning liquid L from a discharge path 15E that serves as the second discharge path and that is provided with an opening/closing portion 16E that serves as the second opening/closing portion.

The opening/closing portion 16D and the opening/closing portion 16E are specifically valves. When the inkjet printer 1 is used, the opening/closing portion 16D is closed so as to cause the discharge path 15D to be in a closed state, and the opening/closing portion 16E is closed so as to cause the discharge path 15E to be in a closed state. In this way, the cleaning liquid L can be suitably stored in the first cleaning liquid tank 12A and the second cleaning liquid tank 12B. Further, when the inkjet printer 1 is not used, the opening/closing portion 16D is opened to cause the discharge path 15D to be in an open state, and the opening/closing portion 16E is opened to cause the discharge path 15E to be in an open state. In this way, the cleaning liquid L can be suitably discharged from the first cleaning liquid tank 12A and the second cleaning liquid tank 12B.

Note that the buffer region is provided at a position located further downstream than the second cleaning liquid tank 12B in the direction in which the cleaning liquid L flows. A discharge path 15F provided with an opening/closing portion 16F is provided in the buffer region, and the cleaning liquid L can be discharged from the discharge path 15F. The opening/closing portion 16F is specifically a valve. The supply source of the cleaning liquid L, such as the tap, basically stops supplying the cleaning liquid L once a sufficient amount of the cleaning liquid L has been stored in the first cleaning liquid tank 12A and the second cleaning liquid tank 12B. However, if the cleaning liquid L overflows from the second cleaning liquid tank 12B for whatever reason, the cleaning liquid L is stored in the buffer region. In the ink jet printer 1, normally, the opening/closing portion 16F is closed, and the discharge path 15F is in a closed state. In this way, the cleaning liquid L overflowing from the second cleaning liquid tank 12B is stored in the buffer region. Then, by opening the opening/closing portion 16F at any given timing, the discharge path 15F is caused to be in an open state, and the cleaning liquid L stored in the buffer region is discharged from the discharge path 15F. For example, by providing a liquid level sensor or the like in the buffer region, the user may be notified when the cleaning liquid L stored in the buffer region exceeds a predetermined amount and may be prompted to discharge the cleaning liquid L stored in the buffer region. Note that a configuration may be adopted in which the buffer region is not provided.

Further, the cleaning unit 10B of this example is provided with the blade portion 13 that wipes off the cleaning liquid L attached to the transporting belt 5 as a result of bringing the first brush 11A and the second brush 11B into contact with the transporting belt 5.

Furthermore, in the cleaning unit 10B of this example, the set of the first brush 11A and the first cleaning liquid tank 12A, and the set of the second brush 11B and the second cleaning liquid tank 12B are not respectively configured to be individually movable in the horizontal direction D and the vertical direction E. However, the cleaning unit 10B of this example includes a rotating shaft 18 and is configured to be able to rotate integrally in the rotation direction C1 and the rotation direction C2 around the rotating shaft 18.

As described above, in the inkjet printer 1 of this example, the first cleaning liquid tank 12A and the second cleaning liquid tank 12B are formed by being partitioned by the partition 17, which partitions a single tank into a plurality of compartments. In this way, the inkjet printer 1 of this example easily forms the first cleaning liquid tank 12A and the second cleaning liquid tank 12B by partitioning the single tank.

In addition, as described above, in the inkjet printer 1 of this example, the first cleaning liquid tank 12A and the second cleaning liquid tank 12B are configured to be movable integrally. In this way, in the inkjet printer 1 of this example, since the first cleaning liquid tank 12A and the second cleaning liquid tank 12B are movable integrally, the positions of the first cleaning liquid tank 12A and the second cleaning liquid tank 12B relative to the transporting belt 5 can be adjusted integrally.

Note that the present disclosure is not limited to the above-described examples, and various modifications are possible within the scope of the disclosure as described in the appended claims. It goes without saying that such modifications also fall within the scope of the present disclosure.

What is claimed is:

1. An inkjet printer comprising:

an endless transporting belt configured to transport a medium in a transport direction by supporting the medium and rotating;

an ejecting unit configured to eject ink onto the medium supported by the transporting belt; and a cleaning unit including a first brush for cleaning the transporting belt, a first cleaning liquid tank that stores cleaning liquid with which the first brush is impregnated, a second brush for cleaning the transporting belt, and a second cleaning liquid tank that stores the cleaning liquid with which the second brush is impregnated, wherein the second cleaning liquid tank is disposed at a position lower than the first cleaning liquid tank in a vertical direction, and the cleaning unit is configured so that the cleaning liquid discharged from the first cleaning liquid tank is supplied to the second cleaning liquid tank, wherein the first cleaning liquid tank includes a first discharge path for discharging the cleaning liquid stored in the first cleaning liquid tank without supplying the cleaning liquid to the second cleaning liquid tank and a first opening/closing portion that opens and closes the first discharge path, and wherein the second cleaning liquid tank includes a second discharge path for discharging the cleaning liquid stored in the second cleaning liquid tank and a second opening/closing portion that opens and closes the second discharge path.

2. The inkjet printer according to claim 1, wherein the first cleaning liquid tank and the second cleaning liquid tank are constituted respectively by individual tanks separated from each other, and the cleaning unit includes a cleaning liquid flow path for supplying the cleaning liquid discharged from the first cleaning liquid tank to the second cleaning liquid tank.

3. The inkjet printer according to claim 2, wherein the first cleaning liquid tank and the second cleaning liquid tank are configured to be movable independently of each other.

4. The inkjet printer according to claim 1, wherein the first cleaning liquid tank and the second cleaning liquid tank are formed by partitioning, by a partition part, a single tank into a plurality of compartments.

5. The inkjet printer according to claim 1, wherein the first cleaning liquid tank and the second cleaning liquid tank are configured to be integrally movable.

* * * * *